US006422875B1

(12) United States Patent
Patak et al.

(10) Patent No.: US 6,422,875 B1
(45) Date of Patent: Jul. 23, 2002

(54) DEVICE FOR COMMUNICATING WITH A VOICE-DISABLED PATIENT

(76) Inventors: Lance Patak; Paul Masvidal, both of 1216 S. Ogden Dr., Los Angeles, CA (US) 90019

( * ) Notice: Subject to any disclaimer, the term of this patent is extended or adjusted under 35 U.S.C. 154(b) by 0 days.

(21) Appl. No.: 09/312,425

(22) Filed: May 14, 1999

Related U.S. Application Data

(60) Provisional application No. 60/116,210, filed on Jan. 19, 1999.

(51) Int. Cl.[7] ..... B43L 1/00; B42D 15/00

(52) U.S. Cl. ..... 434/408; 434/416; 434/267; 434/262; 281/42; 281/44; 281/45; 283/115

(58) Field of Search ..... 281/42, 44, 45, 281/39; 283/115; 434/408, 117, 112, 415, 416, 267, 262

(56) References Cited

U.S. PATENT DOCUMENTS 4,605,246 A * 8/1986 Haas et al. ..... 282/29
4,730,846 A * 3/1988 Sheehan et al. ..... 281/45
4,869,531 A * 9/1989 Rees ..... 283/67
5,297,814 A * 3/1994 Peters ..... 281/45
5,720,502 A * 2/1998 Cain ..... 283/115
5,725,250 A * 3/1998 Balderrama ..... 281/45
5,758,902 A * 6/1998 McManus ..... 281/45
5,823,574 A * 10/1998 Sullins et al. ..... 281/45
5,913,686 A * 6/1999 VanWinkle ..... 434/267
5,984,368 A * 11/1999 Cain ..... 283/115

* cited by examiner

*Primary Examiner*—Jacob K. Ackun
*Assistant Examiner*—Bena B. Miller
(74) *Attorney, Agent, or Firm*—Kelly, Bauersfeld, Lowry & Kelley LLP

(57) ABSTRACT

A device for communicating with a voice-disabled patient includes, generally, a housing having a display surface, indicia on the display surface that may be utilized by the patient to indicate the status and needs of the patient, and a marker that the patient may use to convey his or her status and needs to a third party. One embodiment includes a clipboard having two eraser-board surfaces and an erasable marker connectable to the clipboard. Another embodiment includes a lap-sized housing for a computer and a touch pad-activated screen. In both embodiments, the indicia includes a series of descriptive words and phrases indicating the status and needs of the patient, and graphical representations of anterior and posterior views of a human body with descriptive words correlating to common symptoms of specific parts of the body.

6 Claims, 2 Drawing Sheets

DEVICE FOR COMMUNICATING WITH A VOICE-DISABLED PATIENT

RELATED APPLICATION

This application claims priority from provisional application Ser. No. 60/116,210 filed Jan. 19, 1999.

BACKGROUND OF THE INVENTION

Characteristic of cardiothoracic surgery is the post-operative patient who is sent to the Intensive Care Unit (ICU) intubated due to respiratory requirements. Approximately half of these patients are extubated within their first twenty-four post-operative hours. In most cases these patients are extubated within the first three days. There are some, however, who remain intubated for a significant length of time. When a surgeon identifies a patient who will require intubation longer than seven days, the surgeon will usually decide to perform a tracheotomy on that patient. The breathing support tube enters the trachea rather than entering the mouth for the trached patient. Communication for a intubated or trached patient is minimal due to the inability to speak resulting in the patient, hospital staff and loved ones resorting to the reading of lips, nodding of heads and squeezing of hands to communicate.

Without effective communication, the intubated or trached patient may not receive the standard of care he or she would otherwise receive had he or she been able to effectively communicate. The lack of communication also creates unnecessary levels of anxiety which the patient must endure. Nurses and hospital staff ask many questions from the patient pertaining to their prognosis and progress which may never get fully or even adequately answered. A doctor or nurse is not able to treat a symptom which they know little or nothing about. In addition, other problems arise due to the insufficient communication from the patient. Localized areas of pain are often mis-diagnosed, resulting in over-medication generally or the medication of an area which is not the source of pain. Proper and essential treatment given in an adequate and timely manner will help resolve or prevent many post-operative complications and decrease the patient's length of stay in the hospital. This begins with providing the patient a clear and precise means of communication.

Accordingly, there has been a need for an ICU communication device which in the immediate post-operative period can provide assistance to an intubated or trached patient. What is also needed is a device which provides the communicating elements necessary over the patient's post-operative stay in the hospital with not only with medical care providers but also with visiting family and loved ones. Further, a communication device is needed which accomplishes the desired function while being easy to manufacture and use while remaining cost effective. The present invention fulfills these needs and provides other related advantages.

SUMMARY OF THE INVENTION

The present invention resides in a device which facilitates communication between a voice-disabled patient and his or her care provider and others. The device comprises, generally, a housing having at least one display surface, indicia displayable on the display surface, and a marker associated with the housing. The indicia may be utilized by the patient to indicate the status and needs of the patient. The marker is usable by the patient to communicate to a third party the patient's status and needs utilizing the indicia.

In one form of the invention, the device for communicating with a voice-disabled patient comprises a clipboard having at least one eraser-board surface, and an erasable marker attachable to the clipboard, and indicia imprinted onto the eraser-board surface. More particularly, the clipboard includes two eraser-board surfaces, and an eraser is connectable to the clipboard.

In another form of the invention, an electronic device for communicating with a voice-disabled patient comprises a housing, a computer within the housing, a touch pad visual screen disposed on the housing and in electronic communication with the computer, and computerized screen layouts generated by the computer having touch activated icons indicating the patient's status and needs. The housing includes handles, and a speaker is disposed within the housing for audibly transmitting a computerized voice corresponding to the icons displayed on the visual screen.

In both embodiments the indicia includes descriptive words and phrases, and graphical representations of a human body. The indicia may further include a grid containing alphabetical letters, numbers and universal symbols, and a pain scale. Moreover, the words and phrases may include the patient's physical and emotional status, and the graphical representations of the human body may have correlating descriptive words and phrases indicating the physical status of specific parts of the body.

Other features and advantages of the present invention will become apparent from the following more detailed description, taken in conjunction with the accompanying drawings which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENTS

Figure 1:
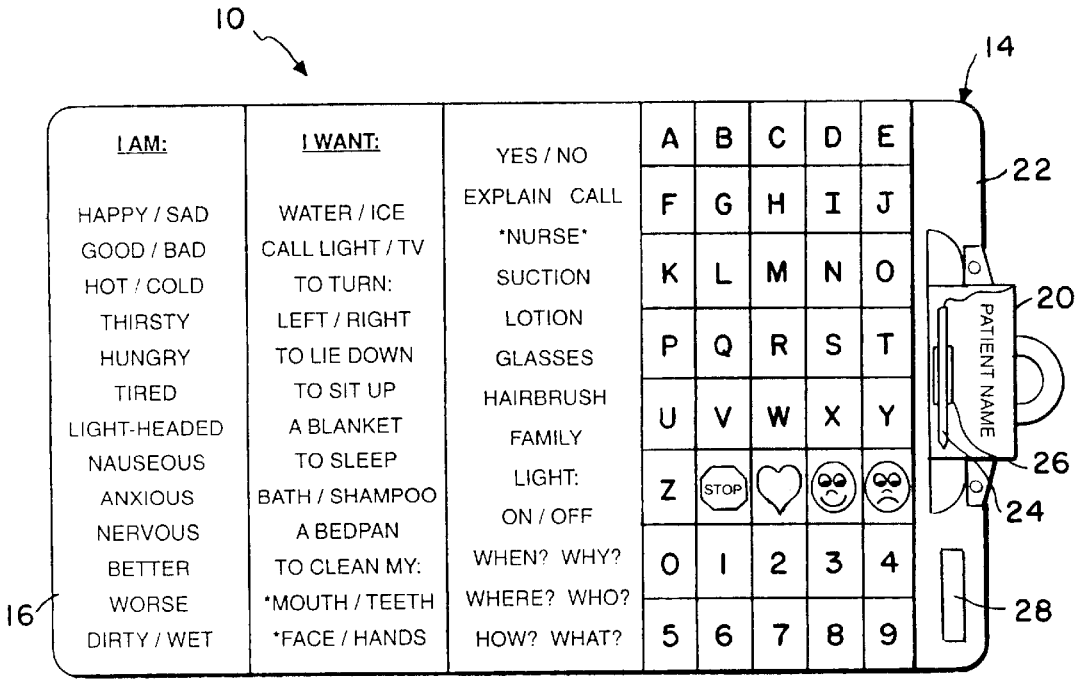
FIG. 1 is a front view of an ICU communication device embodying the present invention.
Figure 2:
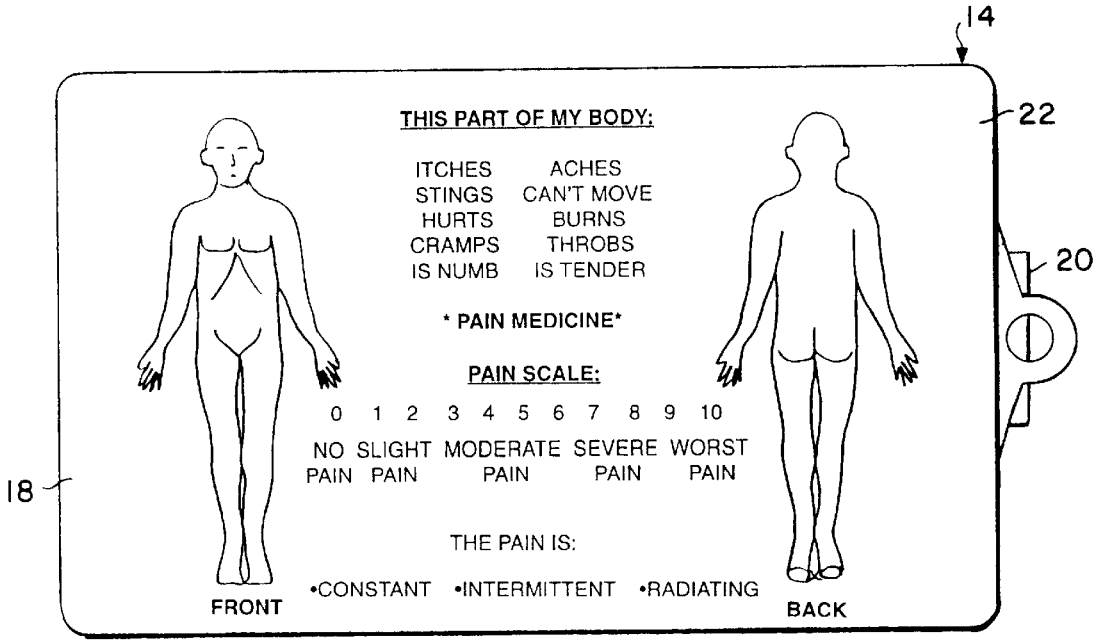
FIG. 2 is a rear view of the ICU communication device of FIG. 1.
Figure 3:
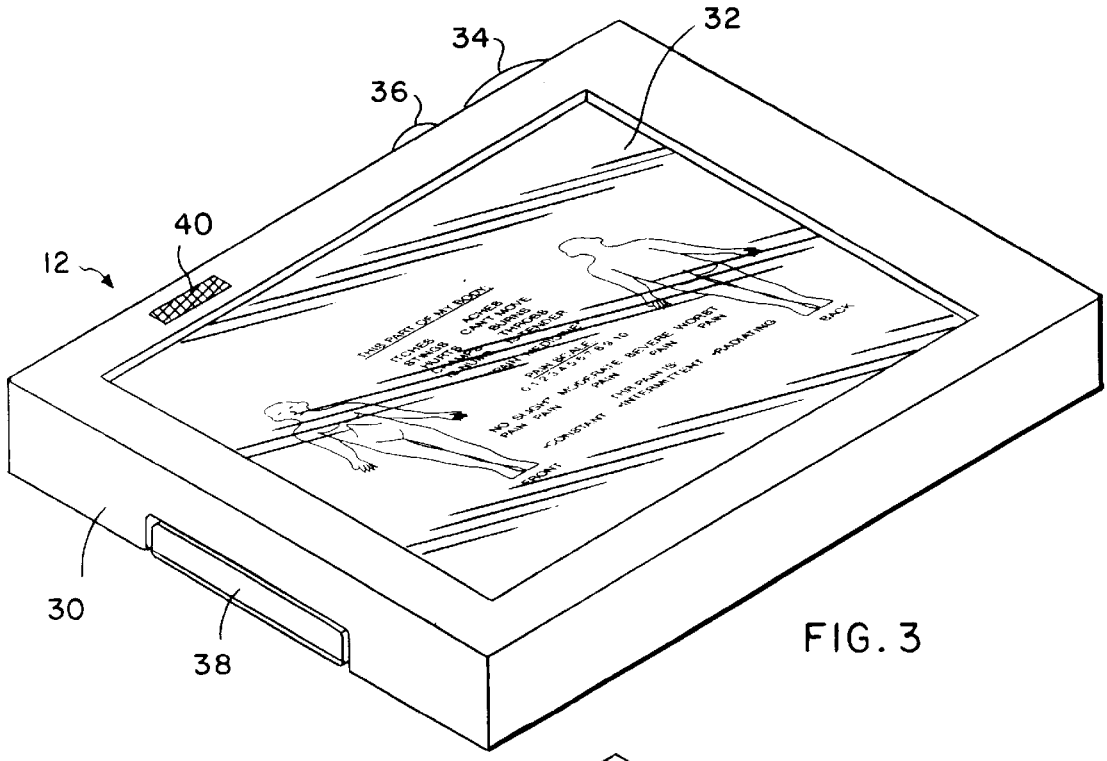
FIG. 3 is a front and side perspective view of a computerized ICU communication device embodying the present invention.
Figure 4:
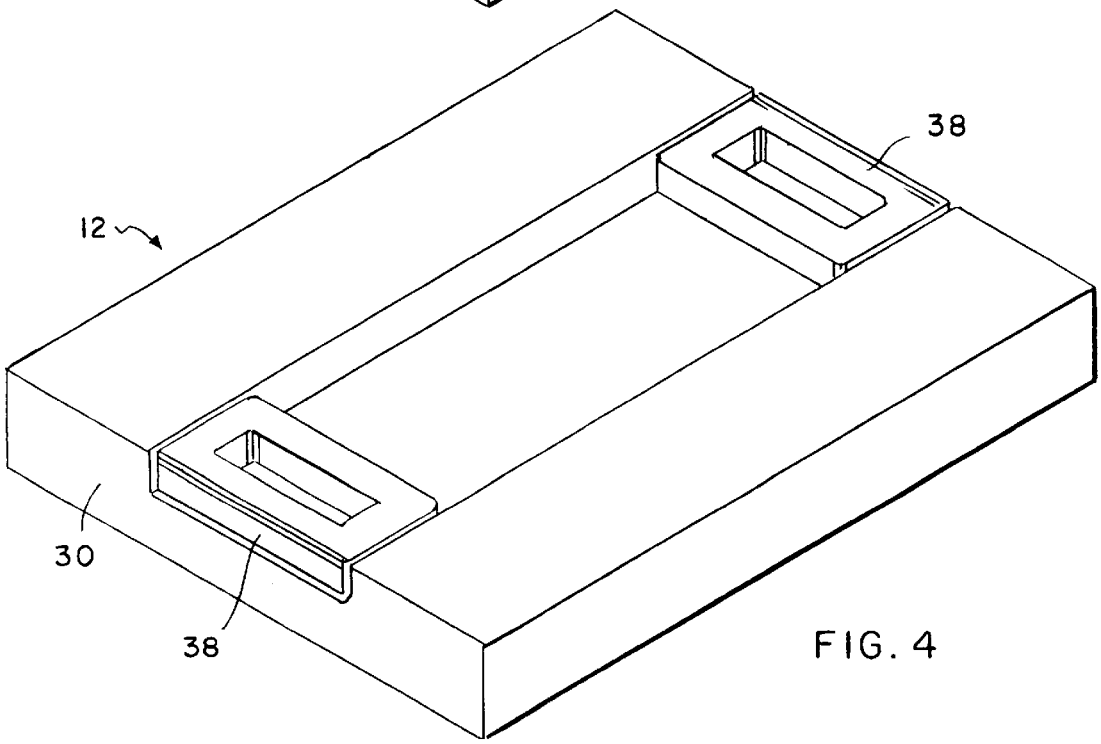
FIG. 4 is a rear and side perspective view of the computerized ICU communication device of FIG. 3.

As shown in the drawings for purposes of illustration, the present invention is concerned with devices for communicating with a voice-disabled patient, generally referred to by the reference number 10 in FIGS. 1 and 2 and by thereference number 12 in FIGS. 3 and 4.

In accordance with the invention and as illustrated in FIGS. 1–2, the communication device 10 is made to resemble a clipboard 14 having dry eraser-board material on it's front and back surfaces 16 and 18. The clipboard 14 preferably includes a clip 20 attached to a board portion 22. An erasable marker 24 is releasably connected to the clipboard 14 by a fastener 26 such as a cable, clip or hook and loop tape. An eraser 28 may also be releasably connected to the clipboard 14 by any adequate means.

Although the clipboard 14 can take on a variety of dimensions, it is preferably 8½"×14" so as to sit in the patient's lap and be stored conveniently when not in use. On the front 16 of the clipboard 14 are imprinted four vertical columns spanning the width of the clipboard (FIG. 1). All imprints are typically transferred onto the dry eraser-board by sublimation, although other adequate imprinting methods may be used. The first three columns are typically approximately 3" in width. The fourth column is approximately 3½" in width.

On the front side 16 of the clipboard 14, a series of words and phrases are imprinted onto the first three columns. In the preferred embodiment, the first column contains the physical and emotional status of the patient. Words and phrases such as "I AM: HOT/COLD, THIRSTY, HUNGRY, TIRED, LIGHT-HEADED, NAUSEOUS, ANXIOUS, NERVOUS, BETTER, WORSE, DIRTY/WET, HAPPY/SAD" are positioned in the vertical column. The second column contains the wants and needs of the patient. Words and phrases such as "I WANT: WATER/ICE, CALL LIGHT/TV, TO TURN, LEFT/RIGHT, TO LIE DOWN, A BLANKET, TO SLEEP, BATH/SHAMPOO, A BEDPAN, TO CLEAN MY MOUTH/TEETH/FACE/HANDS" are listed in this second column. The third column is a miscellaneous column for frequently requested items and words and phrases frequently used in communication in a hospital setting. Words such as "YES/NO, EXPLAIN, CALL, NURSE, SUCTION, LOTION, GLASSES, FAMILY, INSURANCE, LIGHT, ON/OFF, WHEN?, WHY?, WHERE?, WHO?, HOW?, WHAT?" are listed in this column. The fourth column contains a grid imprinted with individual letters of the alphabet and the numbers 0–9. Universal characters and symbols may also be inserted into empty grid boxes.

As illustrated in FIG. 2, on the backside of the clipboard 14, two single-lined drawings of front view (anterior) and back view (posterior) non-gender human bodies are illustrated. On the left side is the anterior body picture with the word "FRONT" underneath, and the right side shows the posterior body picture with the word "BACK" underneath it. Between the two bodies are imprinted descriptive words to express physical experiences relating to any part of the human body. These include the words and phrases: "THIS PART OF MY BODY: ITCHES, ACHES, STINGS, CAN'T MOVE, CAN'T MOVE, HURTS, BURNS, CRAMPS, THROBS, IS NUMB, PAIN MEDICINE". In addition, at the bottom, a nationally established pain scale lists: "PAIN SCALE: 0 1 2 3 4 5 6 7 8 9 10" and the following words indicating a correlation with the degree of pain: "NO PAIN, SLIGHT PAIN, MODERATE PAIN, SEVERE PAIN, WORST PAIN". The phrases are read vertically, with the clipboard 14 held horizontally by its clip 20.

A technologically advanced version is the computerized communication device 12, illustrated in FIGS. 3 and 4. It is also lap-sized (approximately 8½"×11"×1½") and has a housing 30 made of a durable lightweight polycarbon plastic. A touch pad screen 32 is formed within the housing and is in electronic communication with computer controlled electronic circuitry. The screen 32 is made of a hardened clear plastic or LCD surface. The screen 32 is backlit and its contrast is adjustable with a manual dial 34 located on the side of the device 12, preferably in the lower right hand position. The device 12 activates when the screen 32 is touched and when a manual on/off switch 36 is in the "on" position.

The computerized device 12 has a built-in rechargeable battery with an AC adapter (not shown) for both portable and plugged-in operating service. The backside of the device 12 has clip-in, locking side handles 38 which flip outward and to the sides for gripping and carrying (FIG. 4).

The computerized version of the device 12 contains the same information in the form of words and phrases as the clipboard device 10 described above. The computerized device 12 displays the information in different screen layouts which can be accessed by touching a next screen icon on the upper right hand corner of each screen. One screen layout will be entitled the "I AM" screen listing various states of being of the patient. Another screen layout will be entitled the "I WANT" screen, listing various needs and desires of the patient. Two other screen layouts contain lists of words, symbols, and phrases regarding other potential scenarios a patient may encounter while intubated. Lastly, there will be another screen illustrating graphic representations of the anterior and posterior views of androgynous human bodies with a list of symptoms, as indicated in the clipboard device 10, centered between the pictured human bodies, which any part of the body could incur or experience. In addition this screen will include a pain scale as indicated in the aforementioned clipboard version 10. Each word, phrase and symbol listed on the above mentioned screen layouts will activate a computer operated voice dictation of the messages through a built-in speaker 40 when touched. The computerized communication device 12 will have several menu options including choice of language, pediatric variations, and voice style options such as male or female and adult or child computerized voices.

The present invention benefits the patient who is post-operatively intubated or trached or otherwise voiceisabled. The degree of anxiety in the patient is reduced as he or she is assured a means of communication while intubated. The present invention also aids the health care provider in communicating with the intubated patient, allowing the health care provider to address specific patient needs and concerns resulting in better overall care. The communication devices 10 and 12 of the present invention can be produced to meet individual needs of foreign language speaking patients, which also aids the non-foreign language speaking health care provider.

Although two embodiments of the invention have been described in detail for purposes of illustration, various modifications may be made to each without departing from the scope and spirit of the invention. Accordingly, the invention is not to be limited, except as by the appended claims.

What is claimed is:

1. A device for intubated or voice-disabled patients to facilitate communication with their care providers or family to meet the physical, emotional, and psychological needs of the intubated or voice-disabled patient, the device comprising:

a board having oppositely facing surfaces;

a listing of descriptive words and phrases pre-printed onto at least one surface of the board indicating the patient's current physiological and emotional status, and physical needs and wants, selected from the group consisting of: water, thirsty, ice, hungry, medicine, suction, sit, bath, blanket, happy, good, hot, better, wet, tired, light-headed, nauseous, anxious, sad, bad, cold, worse, dirty, sleep, bedpan, family, glasses, lotion, hairbrush, light, television, and clean;

a graphical representation of front and back sides of a human body including a head, neck, torso, legs, and arms pre-printed onto at least one of the surfaces of the board;

descriptive words and phrases pre-printed onto at least one of the surfaces of the board and associated with the graphical representation of the human body for indicating the location of physical experiences, including pain;

a grid pre-printed onto at least one of the surfaces of the board and containing a sequential listing of letters of an alphabet for the patient to spell out words which are not printed on the board; and a marker associated with the board and usable by the patient to mark the pre-printed descriptive words and phrases, graphical representation of the body, or grid of alphabetical letters to communicate the voice-disabled patient's physical and emotional status and needs to a family member or care provider.

2. The device of claim 1, wherein the descriptive words and phrases associated with the graphical representation of the body selected from the group consisting of: itches, stings, hurts, numb, cramp, aches, burns tender, can't move, and throbs.

3. The device of claim 1, including a pain scale pre-printed onto at least one of the surfaces of the board and associated with the graphical representation of the body and indicating the severity of the pain.

4. The device of claim 1, including a grid pre-printed onto at least one of the surfaces of the board and sequentially listing the numbers 0 through 9.

5. A device for intubated or voice-disabled patients to facilitate communication with their care providers or family to meet the physical, emotional, and psychological needs of the intubated or voice-disabled patient, the device comprising:

a board having oppositely facing surfaces;

a listing of descriptive words and phrases pre-printed onto at least one of the surfaces of the board indicating the patient's current physiological and emotional status, and physical needs and wants, selected from the group consisting of: water, thirsty, ice, hungry, medicine, suction, sit, bath, blanket, happy, good, hot, better, wet, tired, light-headed, nauseous, anxious, sad, bad, cold, worse, dirty, sleep, bedpan, family, glasses, lotion, hairbrush, light, television, and clean;

a graphical representation of front and back sides of a human body including a head, neck, torso, legs, and arms pre-printed onto at least one of the surfaces of the board;

descriptive words and phrases pre-printed onto at least one of the surfaces of the board and associated with the graphical representation of the human body for indicating the location of physical experiences, including pain;

a pain scale pre-printed onto at least one of the surfaces of the board and associated with the graphical representation of the body and indicating the severity of the pain;

a grid pre-printed onto at least one of the surfaces of the board and containing a sequential listing of letters of an alphabet; and a marker associated with the board and usable by the patient to mark the pre-printed descriptive words and phrases, graphical representation of the body, or grid of alphabetical letters to communicate the voice-disabled patient's physical and emotional status and needs to a family member or care provider;

wherein the descriptive words and phrases associated with the graphical representation of the body selected from the group consisting of: itches, stings, hurts, numb, cramp, aches, burns, tender, can't move, and throbs.

6. The device of claim 5, including a grid pre-printed onto at least one surface of the board and sequentially listing the numbers 0 through 9.

* * * * *